US010912387B2

(12) United States Patent
Smit

(10) Patent No.: US 10,912,387 B2
(45) Date of Patent: Feb. 9, 2021

(54) SEAT AND METHOD OF ASSEMBLING A SUPPORT THEREOF

(71) Applicant: F. SMIT HOLDING B.V., Ka Doetinchem (NL)

(72) Inventor: Fernando Smit, Ka Doetinchem (NL)

(73) Assignee: F. SMIT HOLDING B.V., Doetinchem (NL)

( * ) Notice: Subject to any disclaimer, the term of this patent is extended or adjusted under 35 U.S.C. 154(b) by 0 days.

(21) Appl. No.: 16/315,523

(22) PCT Filed: Jul. 5, 2017

(86) PCT No.: PCT/NL2017/050451

§ 371 (c)(1),
(2) Date: Jan. 4, 2019

(87) PCT Pub. No.: WO2018/030894

PCT Pub. Date: Feb. 15, 2018

(65) Prior Publication Data

US 2019/0254433 A1 Aug. 22, 2019

(30) Foreign Application Priority Data

Jul. 7, 2016 (NL) ..... 2017124

(51) Int. Cl.
*A47C 1/04* (2006.01)
*A47C 3/18* (2006.01)
(Continued)

(52) U.S. Cl.
CPC ..... *A47C 7/004* (2013.01); *A47C 1/04* (2013.01); *A47C 3/18* (2013.01); *A47C 4/028* (2013.01);
(Continued)

(58) Field of Classification Search
CPC .... A47C 1/04; A47C 3/18; A47C 3/20; A47C 4/20; A47C 7/002; A47C 7/004; A47C 7/006; A47C 9/02; A47C 9/105
See application file for complete search history.

(56) References Cited

U.S. PATENT DOCUMENTS 361,527 A * 4/1887 Kazanjian ..... A47C 9/105 108/158
582,136 A * 5/1897 Comfort ..... A47C 4/286 297/51
(Continued)

FOREIGN PATENT DOCUMENTS

CH 86539 A * 9/1920 ..... A47C 9/105
CN 106175222 A * 12/2016
(Continued)

OTHER PUBLICATIONS

International Search Report and Written Opinion for International Application No. PCT/NL2017/050451 dated Sep. 12, 2017, 13 pages.
(Continued)

*Primary Examiner* — Ryan D Kwiecinski
(74) *Attorney, Agent, or Firm* — Kacvinsky Daisak Bluni PLLC

(57) ABSTRACT

A seat includes a seat surface and a central leg with feet close to an end remote from the seat surface. The feet are movable between a transport position substantially parallel to the leg and an operative position extending substantially radially from the leg. Several feet are connected to each other by at least one connecting element extending from the leg. A method includes supplying a central leg with feet in a transport position directed substantially parallel to the leg, supplying at least one connecting element, moving the feet from the transport position to an operative position extending substantially in radial direction from the leg, and con-
(Continued)

necting at least several feet to each other using the connecting element, wherein the connecting element extends at a distance from the central leg.

21 Claims, 8 Drawing Sheets

(51) Int. Cl.
*A47C 4/20* (2006.01)
*A47C 7/00* (2006.01)
*A47C 4/02* (2006.01)
*A47C 4/04* (2006.01)

(52) U.S. Cl.
CPC ..... *A47C 4/04* (2013.01); *A47C 4/20* (2013.01); *A47C 7/006* (2013.01)

(56) References Cited

U.S. PATENT DOCUMENTS

| | | | | | |
|---|---|---|---|---|---|
| 2,445,489 | A * | 7/1948 | Mangold | A47C 9/105 | 108/41 |
| 3,262,406 | A * | 7/1966 | Nickolaisen | A47C 3/18 | 297/461 |
| 3,682,425 | A * | 8/1972 | Vincent | A47C 7/004 | 248/188.7 |
| 4,807,837 | A * | 2/1989 | Gawlik | A61M 5/1415 | 211/196 |
| 5,149,035 | A * | 9/1992 | Bonnema | A47C 5/12 | 248/188.7 |
| 5,836,555 | A * | 11/1998 | Ellsworth | A47C 7/004 | 248/161 |
| D530,932 | S * | 10/2006 | Hieshetter | D6/360 | |
| D598,209 | S * | 8/2009 | Lippert | D6/367 | |
| 9,346,505 | B1 * | 5/2016 | Wilgosz | B62J 1/28 | |
| 9,833,892 | B1 * | 12/2017 | Gomez | B25H 1/04 | |
| 2002/0195528 | A1 * | 12/2002 | Overbeck | A47C 4/20 | 248/188.6 |
| 2017/0007026 | A1 * | 1/2017 | Avery | A47C 4/10 | |
| 2017/0343151 | A1 * | 11/2017 | Kjellman | A47B 13/023 | |
| 2018/0317646 | A1 * | 11/2018 | Rassat | A47B 13/023 | |

FOREIGN PATENT DOCUMENTS

| | | | | |
|---|---|---|---|---|
| DE | 202013010512 | U1 * | 12/2013 | A47C 7/004 |
| EP | 0386832 | A1 | 9/1990 | |
| EP | 3248504 | A1 * | 11/2017 | A47B 9/16 |
| FR | 2568115 | A1 * | 1/1986 | |
| GB | 211678 | A * | 2/1924 | A47C 9/105 |
| GB | 1209765 | A * | 10/1970 | A47C 7/004 |
| GB | 2519952 | A | 5/2015 | |
| JP | S48111419 | U | 12/1973 | |
| WO | 2005018384 | A1 | 3/2005 | |
| WO | WO-2005018384 | A1 * | 3/2005 | A47C 7/004 |

OTHER PUBLICATIONS

International Preliminary Report of Patentability and Written Opinion for the International Application No. PCT/NL2017/050451, dated Jan. 24, 2019, 8 pages.

* cited by examiner

SEAT AND METHOD OF ASSEMBLING A SUPPORT THEREOF

This is a national stage application filed under 35 U.S.C. § 371 of pending international application PCT/NL2017/050451 filed Jul. 5, 2017, which claims priority to Netherlands Patent application NL 2017124, filed Jul. 7, 2016, the entirety of which applications are hereby incorporated by reference herein.

The invention relates to a seat comprising a seat surface and, connected thereto, a central leg which is provided with a number of feet close to an end remote from the seat surface, which feet are each movable between a collapsed position directed substantially parallel to the leg and an operative position extending substantially in radial direction from the leg. Such a seat is known, for instance from U.S. Pat. No. 5,437,425 A.

In the known seat the central leg is provided on its underside with a number of radially extending reverse U-shaped profiles which each receive a foot in pivotable manner. Received in each foot, this taking the form of a box profile, is a retainer spring which fixes the foot in its collapsed or extended position. The pivotable form of the feet enables the known seat to be collapsed into a compact whole. The stability of the seat is however limited thereby. This stability is particularly important for seats which are used intensively, such as for instance seats used by computer game players. Such gamers often sit in their seat for a prolonged period of time and, in the heat of the game, often move around intensively, whereby the seat and particularly also the support thereof is relatively heavily loaded.

The invention has for its object to improve a seat of the above described type, such that it is better suited to intensive use, such as while playing computer games.

According to the invention, this is achieved in such a seat in that at least several feet are connected to each other by at least one connecting element extending at a distance from the central leg. This connecting element increases the stability of the support and, with this, of the whole seat.

In an embodiment of the invention the at least one connecting element is embodied with tensile and compressive stiffness. A stable and robust connection between the feet is thus achieved in the operative position.

When the at least one connecting element is embodied with bending stiffness, the user can also rest his/her feet thereon. This is particularly important in seats which are used intensively, for instance gaming seats which are used by computer game players.

When each foot has an inner end part connected movably to the central leg and, opposite thereto, an outer end part removed from the central leg, and when the at least one connecting element extends substantially between the outer end parts of two adjacent feet, an optimal stability is achieved owing to the great distance between the connecting element and the leg.

The moveability between the transport position and the operative position can be achieved in structurally simple manner when the inner end part of each foot is pivotally connected to the central leg.

In order to be able on the one hand to make the support of the seat smaller in simple manner, but on the other hand to obtain a very strong and stable whole, the at least one connecting element can be releasably mounted on the feet connected thereby. The mounting, for instance by means of bolts, provides here for strength and stiffness, while the releasable character of the mounting ensures that the seat can be stored or transported compactly.

A stiff yet still light support is obtained here when each foot has a substantially reverse U-shaped cross-section and, at the position of the outer end part, comprises a reinforcing block incorporated in the U-shape. The U-profile is light and stiff, while the reinforcing block forms a component on which connecting elements and other components can be mounted.

A wheel, which can be mounted pivotally in the reinforcing block, can thus for instance be connected to each foot. Particularly in the case of gaming seats it is practical for these seats to be mobile.

When the at least one connecting element comprises a circle segment, the connecting element can also function as suitably placed footrest for a user of the seat.

It is thus possible to envisage the at least one connecting element being connected to all feet and substantially wholly surrounding the central leg. The connecting element then forms a circumferential footrest for the user of the seat, so that it does not matter which position the (usually rotatable) seat surface takes up relative to the central leg and the feet of the seat.

A similar effect can be achieved when each foot is connected to adjacent feet on either side by two connecting elements, and the connecting elements together substantially wholly surround the central leg. In this case the successive connecting elements also form a circumferential construction, which can be used as footrest by a user of the seat, irrespective of the position of the seat surface.

The invention also relates to a method for assembling a support of a seat, which support comprises a central leg connected to a seat surface and provided with a number of feet close to an end remote from the seat surface. The method of assembly according to the present invention comprises the steps of supplying the central leg with the feet in a transport position directed substantially parallel to the leg, supplying at least one connecting element, moving the feet from the transport position to an operative position extending substantially in radial direction from the leg, and connecting at least several feet to each other by means of the at least one connecting element, wherein the at least one connecting element extends at a distance from the central leg. A support for a seat can thus be converted quickly and efficiently from a collapsed transport position, in which the support is compact and can be transported in simple manner, to an extended operative position in which the support supports the seat in strong and stable manner.

When each foot has an inner end part movably connected to the central leg and, opposite thereto, an outer end part removed from the central leg, it is advantageous for the at least one connecting element to be arranged substantially between the outer end parts of two adjacent feet. The adjacent feet and the connecting element mounted therebetween at the ends thus form a triangle with maximum dimensions (within the boundaries of the support), which ensures the stiffness and stability.

A simple method of assembly is obtained when the feet are pivoted from the transport position to the operative position.

For an optimal compromise between strength and stiffness of the construction on the one hand and ease of assembly and disassembly of the seat on the other hand it is preferred for the at least one connecting element to be releasably mounted on the feet to be connected thereby.

In order to make the seat applicable in a variety of circumstances, it is possible to connect to each foot a wheel which is mounted pivotally in a reinforcing block incorporated in the foot. The seat can thus be mobile, without this being detrimental to the strength and stability.

According to an embodiment of the invention described here, the number of supplied connecting elements can correspond to the number of feet and each foot can be connected to adjacent feet on either side by two connecting elements, such that the connecting elements together substantially wholly surround the central leg. The connecting elements thus form a continuous support ring for the feet of a user.

As a result of the compact construction of the seat support described here the central leg with the feet and the at least one connecting element can be supplied in a shared packaging. This is important with a view to the costs for transport and storage.

The invention is now elucidated on the basis of an embodiment, wherein reference is made to the accompanying drawing in which corresponding components are designated with the same reference numerals, and in which.

Figure 4:
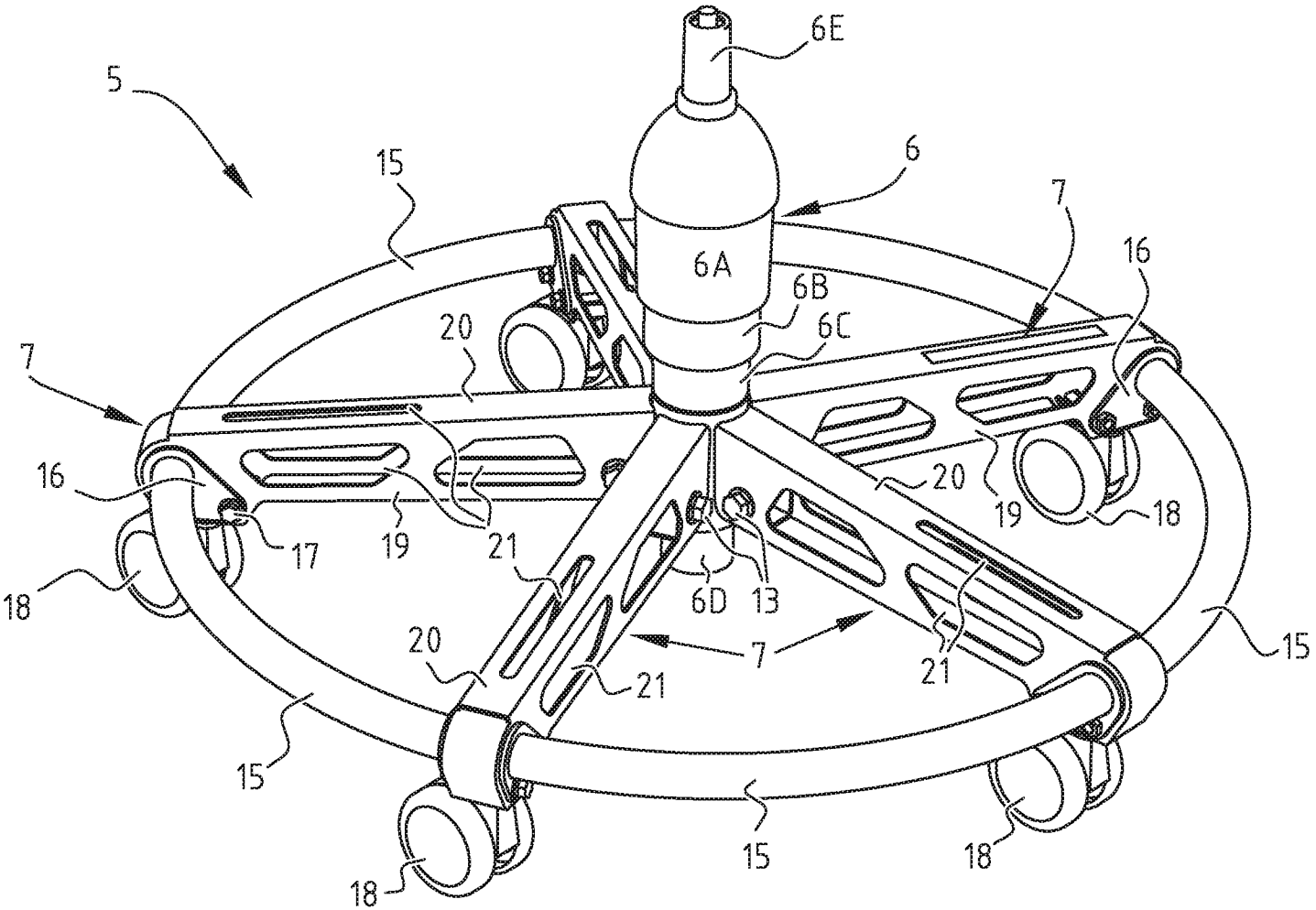
FIG. 4 is a perspective view of a support of the seat of FIG. 1-3.
Figure 5:
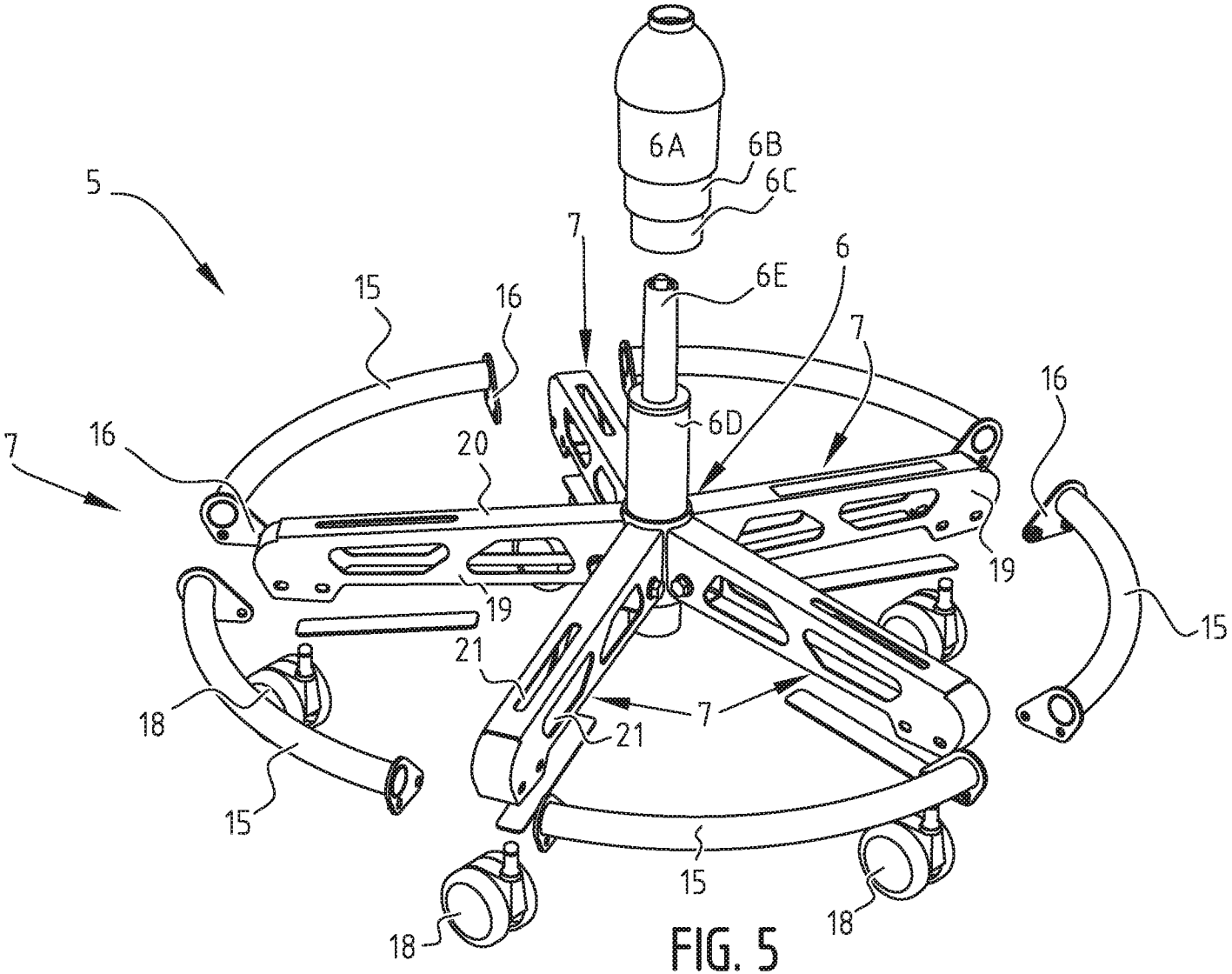
Figure 7:
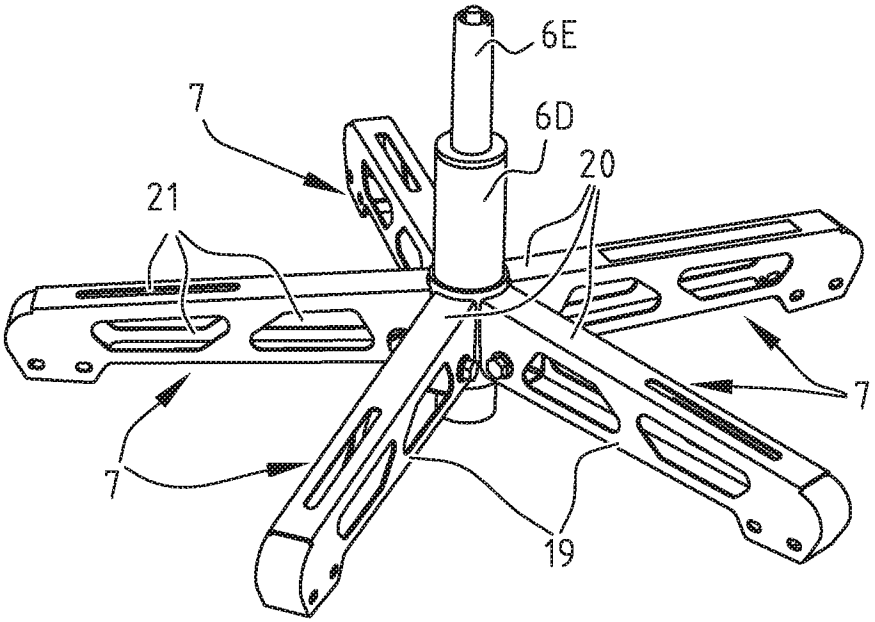
Figure 6:
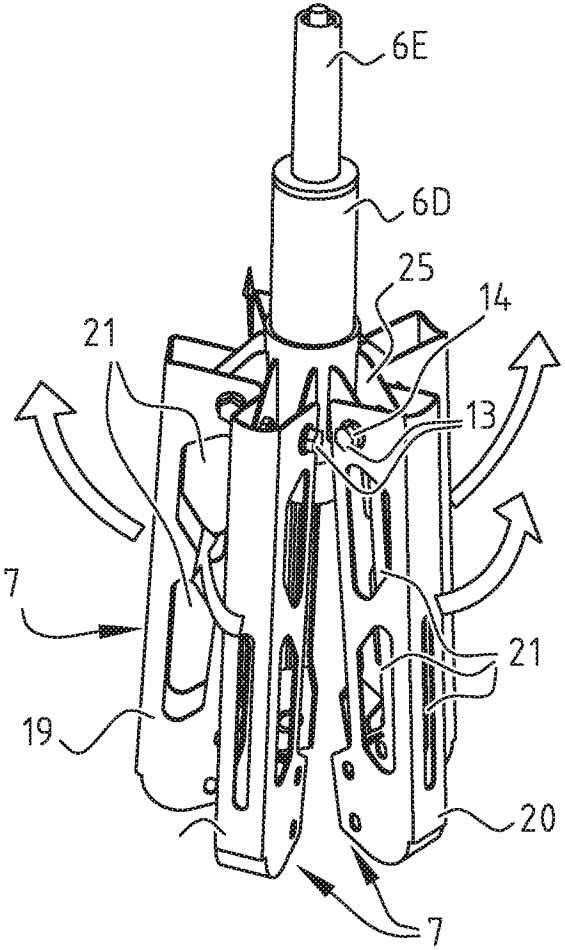
Figure 8:
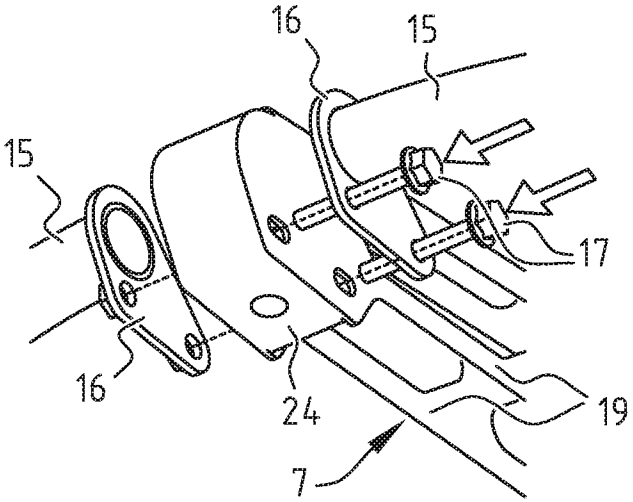
Figure 9:
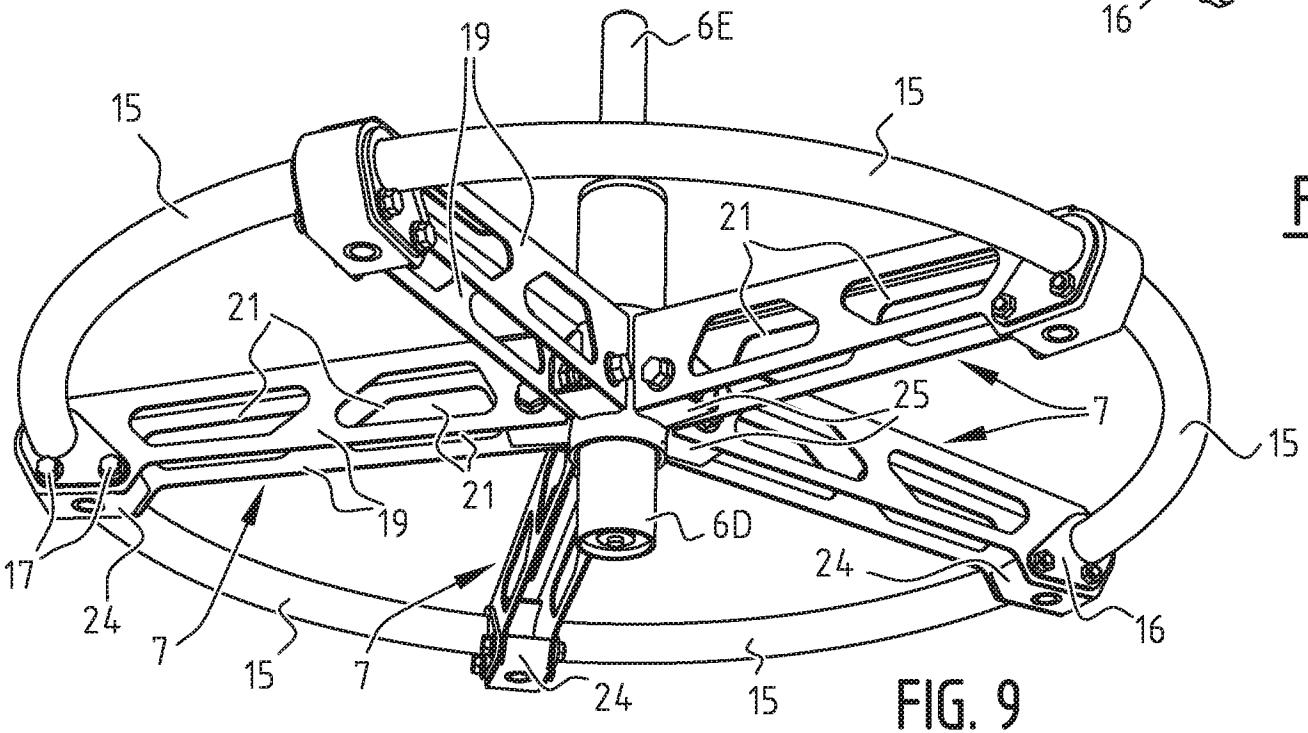
Figure 10:
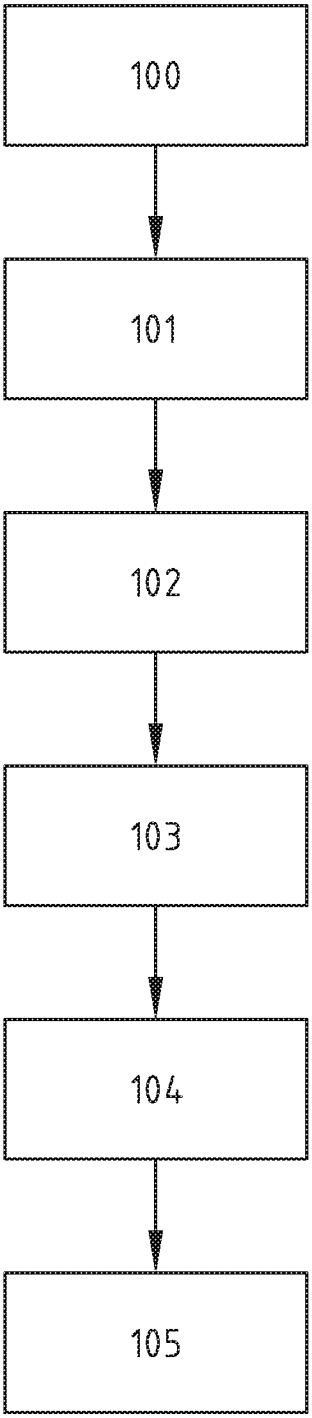

FIG. 5 is a perspective view with exploded parts of the support of FIG. 4, FIG. 6 is a perspective view of a portion of the support in collapsed position, FIG. 7 is a perspective view of the part shown in FIG. 6 in extended position, FIG. 8 is a perspective view which shows how connecting elements of the support are mounted, FIG. 9 is a perspective bottom view of the support before it has been provided with wheels, and FIG. 10 is a flow diagram showing the most important steps of the method according to the invention.

Figure 1:
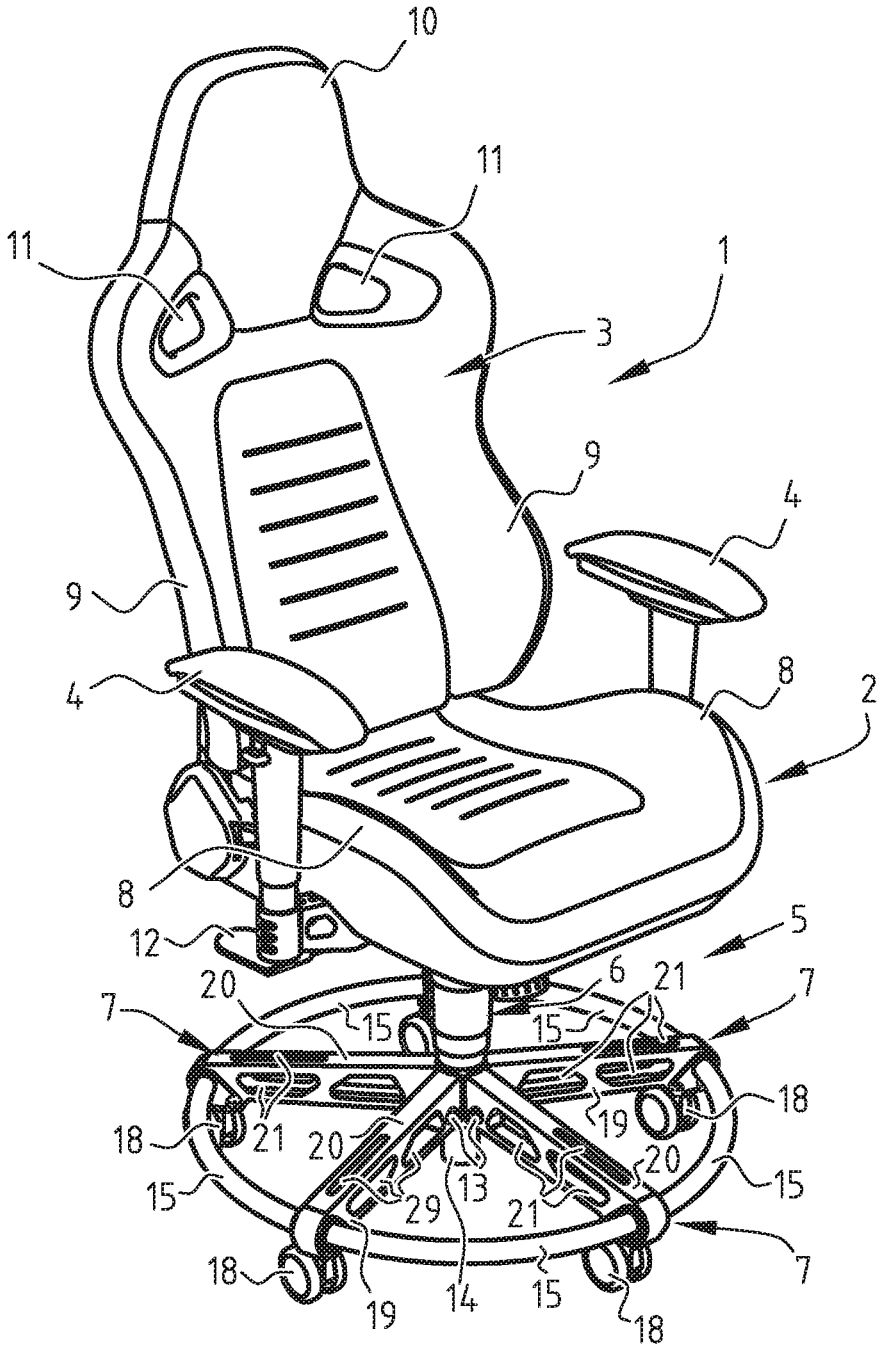
FIG. 1 is a perspective front view of a seat according to the invention.
Figure 2:
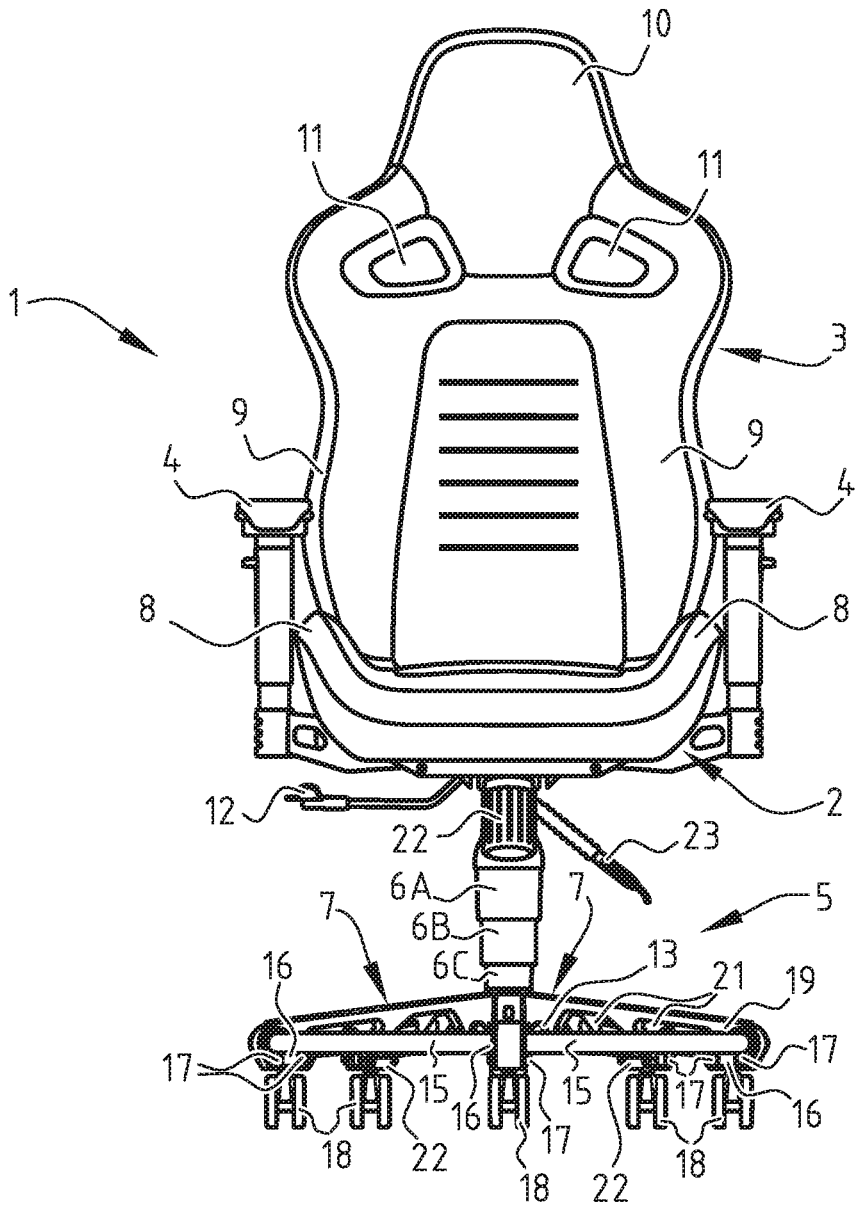
FIG. 2 is a front view of the seat of FIG. 1.
Figure 3:
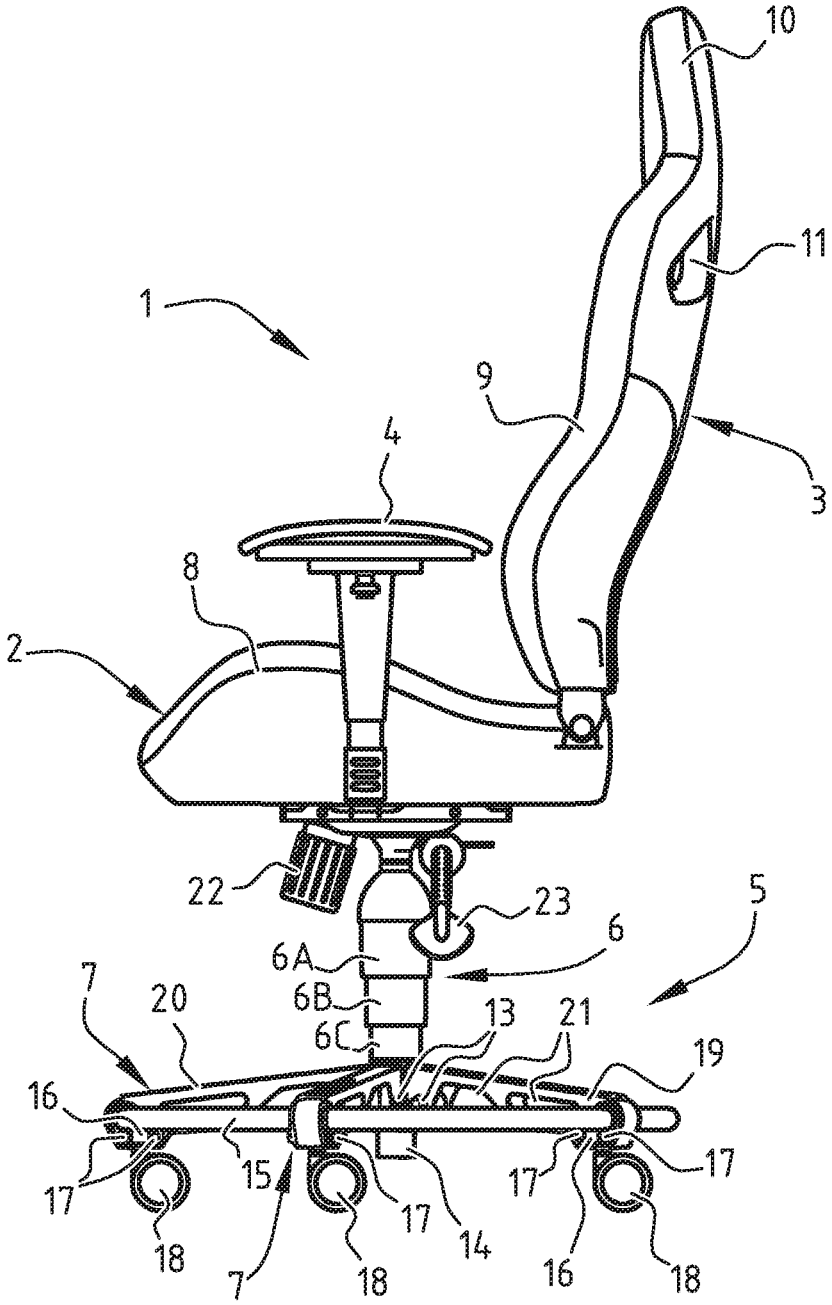
FIG. 3 is a side view of the seat of FIGS. 1 and 2.

A seat 1 comprises a seat surface 2, a backrest 3 and a pair of armrests 4 (FIG. 1). Seat surface 2 is supported by a support 5, in the shown embodiment a mobile support, comprising a central leg 6 and five feet 7 extending in radial direction.

In the shown embodiment seat 1 is intended for players of computer games, particularly racing games, and therefore takes the form of a car seat with a characteristic bucket form. Wings 8, 9 of seat surface 2 and backrest 3 protrude relatively far for this purpose, while backrest 3 is in addition provided with an integrated headrest 10 and openings 11, which in a car seat serve to guide the seatbelts through.

Central leg 6 of support 5 is provided in conventional manner with a height adjustment and for this purpose takes a partially telescopic form. In the shown embodiment central leg 6 comprises a base part 6D and a narrowed part 6E (FIG. 5), on which are arranged three parts 6A-6C which are slidable relative to each other. These three telescopic parts 6A-6C are mutually slidable in and out of each other by means of a gas spring, mechanical spring or hydraulic system in order to vary the height of seat surface 2 above the ground. The height adjustment is operated by means of a handle 12 under seat surface 2. Seat surface 2, backrest 3 and armrests 4 also have various other adjustment options. The firmness of seat surface 2 can thus be adjusted by means of a rotary knob 22, while a second handle 23 is provided for adjusting a tilt angle of seat surface 2 and backrest 3.

In the shown embodiment feet 7 are connected pivotally to base part 6D of central leg 6. They are hereby movable between a collapsed transport position, in which they are directed parallel to the central leg 6 (FIG. 6), and an operative position in which they protrude in radial direction from leg 6 (FIG. 7). The pivoting connection between each foot 7 and leg 6 is formed by a bolt 13 which extends through an opening 14 in the foot 7 and an opening (not shown here) in a protrusion 25 (FIG. 6, 9) of leg 6. By collapsing feet 7 to the transport position the support 5 can be transported in a relatively small packaging. This is important for limiting the transport costs and, with this, the cost of the seat as much as possible for an end user. Seat surface 2, backrest 3, armrests 4 and all other parts of seat 1 are also packaged as separate components in a transport packaging. In the collapsed position the support 5 will fit easily thereamong.

In order to stabilize feet 7 in the extended operative position, they are in the shown embodiment all connected to each other by a number of connecting elements 15 corresponding to the number of feet 7. In the shown embodiment the connecting elements are each embodied as circle segments so that together they form a ring which wholly surrounds central leg 6. With a view to the stability of support 5 the connecting elements 15 are embodied with tensile and compressive stiffness. They are each mounted with their two ends to the two feet 7 which they connect. Each connecting element 15 is for this purpose provided on both its ends with a flange 16 which can be mounted by means of bolts 17 on the relevant foot 7 (FIG. 8). In the shown embodiment each foot 7 is embodied as a reverse U-shaped profile which is open toward the bottom. In order to enable a firm mounting of connecting elements 15 and the wheels 18 to be discussed below, a reinforcing body 24 (FIG. 9) in which bolts 17 can engage is arranged in the outer end of the hollow profile of each foot 7. As stated, support 5 is further provided with casters 18 which in the shown embodiment are mounted in reinforcing body 24.

Owing to the presence of reinforcing elements 15 the feet 7 can take a relatively light form. In the shown embodiment openings 21 are therefore formed in the side walls 19 and the upper wall 20 of each foot 7. The fact that a reinforcing element 15 extends between each pair of feet 7, whereby reinforcing elements 15 form a continuous ring, has the advantage for users of the seat that they can place their feet on support 5 in any position of the seat surface. This is important because seat surface 2 and backrest 3 are rotatable relative to support 5, whereby seat surface 2 and backrest 3 can take up any random position relative to feet 7. Without a continuous ring of reinforcing elements 15 a user could thus not place his/her feet in the same manner in any position of seat surface 2 and backrest 3, which could result in distraction and annoyance, particularly with gamers.

As stated, as a result of the collapsibility of feet 7 seat 1 can be stored and transported in a relatively compact form. Because reinforcing elements 15 are relatively short and extend only between two feet 7 in the shown embodiment, these reinforcing elements can also be stored and transported in a relatively small packaging. Although it is also possible to envisage forming a continuous ring, which could be connected to each of the feet 7, instead of five separate reinforcing elements, part of the advantage of the compact form would then be lost.

Upon receiving a packaging with the seat according to the invention therein, a user then still has to assemble this seat. All this is shown schematically in FIG. 10. After receiving the packaging with the seat therein (block 100), the receiver will unpack central leg 6 with feet 7 (FIG. 10, block 101 and FIG. 6). He/she will also unpack the connecting elements (block 102). The feet are then extended from their transport position to their operative position extending in radial direction from the leg (FIG. 10, block 103 and FIG. 7), after which connecting elements 15 can be arranged between the adjacent feet 7 (FIG. 10, block 104 and FIG. 8, 9). Wheels 18 can then optionally also be mounted (block 105), although it is also possible to envisage that the seat is not mobile and that small legs or even caps are arranged under feet 7. Support 5 is then ready (FIG. 4) to be assembled with the other components of seat 1; seat surface 2, backrest 3 and armrests 4.

The invention thus provides a seat which can be transported in simple manner, takes up little space during storage and can be assembled in simple manner after transport. The support of the seat is moreover relatively light yet still stiff and stable, and provides a user with a place to rest his/her feet all around.

Although the invention has been described above on the basis of an embodiment, it will be apparent that it is not limited thereto but can be varied in many ways within the scope of the following claims.

The invention claimed is:

1. A seat comprising:

a seat surface and, connected thereto, a central leg which is provided with a number of feet close to an end remote from the seat surface, which feet are each movable between a transport position directed substantially parallel to the leg and an operative position extending substantially in radial direction from the leg, wherein at least several feet are connected to each other by at least one connecting element extending at a distance from the central leg, wherein the at least one connecting element is embodied with tensile, compressive and bending stiffness, wherein each foot has an inner end part connected movably to the central leg and, opposite thereto, an outer end part removed from the central leg, and the at least one connecting element extends substantially between the outer end parts of two adjacent feet, and wherein the at least one connecting element forms a circumferential footrest which is connected to all feet and which wholly surrounds the central leg.

2. The seat as claimed in claim 1, wherein the inner end part of each foot is pivotally connected to the central leg.

3. The seat as claimed in claim 1, wherein the at least one connecting element is releasably mounted on the feet connected thereby.

4. The seat as claimed in claim 3, wherein each foot has a substantially reverse U-shaped cross-section and, at the position of the outer end part, comprises a reinforcing block incorporated in the U-shape.

5. The seat as claimed in claim 4, wherein connected to each foot is a wheel which is mounted pivotally in the reinforcing block.

6. The seat as claimed in claim 1, wherein the at least one connecting element comprises a circle segment.

7. A method for assembling a support of a seat, which support comprises a central leg connected to a seat surface and provided with a number of feet close to an end remote from the seat surface, wherein the method comprises:

supplying the central leg with the feet in a transport position directed substantially parallel to the leg, supplying at least one connecting element, moving the feet from the transport position to an operative position extending substantially in radial direction from the leg, and connecting at least several feet to each other by means of the at least one connecting element, wherein the at least one connecting element extends at a distance from the central leg;

wherein the number of supplied connecting elements corresponds to the number of feet and each foot is connected to adjacent feet on either side by two connecting elements, such that the connecting elements together form a continuous ring wholly surrounding the central leg.

8. The method as claimed in claim 7, wherein each foot has an inner end part movably connected to the central leg and, opposite thereto, an outer end part removed from the central leg, and the at least one connecting element is arranged substantially between the outer end parts of two adjacent feet.

9. The method as claimed in claim 7, wherein the feet are pivoted from the transport position to the operative position.

10. The method as claimed in claim 7, wherein the at least one connecting element is releasably mounted on the feet to be connected thereby.

11. The method as claimed in claim 7, wherein connected to each foot is a wheel which is mounted pivotally in a reinforcing block incorporated in the foot.

12. The method as claimed in claim 7, wherein the central leg with the feet and the at least one connecting element is supplied in a shared packaging.

13. A seat comprising:

a seat surface and, connected thereto, a central leg which is provided with a number of feet close to an end remote from the seat surface, which feet are each movable between a transport position directed substantially parallel to the leg and an operative position extending substantially in radial direction from the leg, wherein at least several feet are connected to each other by at least one connecting element extending at a distance from the central leg, and wherein each foot is connected to adjacent feet on either side by two connecting elements, and the connecting elements together form a continuous ring wholly surrounding the central leg.

14. The seat as claimed in claim 13, wherein the inner end part of each foot is pivotally connected to the central leg.

15. The seat as claimed in claim 13, wherein the at least one connecting element is releasably mounted on the feet connected thereby.

16. The seat as claimed in claim 15, wherein each foot has a substantially reverse U-shaped cross-section and, at the position of the outer end part, comprises a reinforcing block incorporated in the U-shape.

17. The seat as claimed in claim 16, wherein connected to each foot is a wheel which is mounted pivotally in the reinforcing block.

18. The seat as claimed in claim 13, wherein the at least one connecting element comprises a circle segment.

19. The seat as claimed in claim 13, wherein the at least one connecting element is embodied with tensile and compressive stiffness.

20. The seat as claimed in claim 13, wherein the at least one connecting element is embodied with bending stiffness.

21. The seat as claimed in claim 13, wherein each foot has an inner end part connected movably to the central leg and, opposite thereto, an outer end part removed from the central leg, and the at least one connecting element extends substantially between the outer end parts of all feet.

* * * * *